United States Patent [19]

Bailey

[11] Patent Number: 4,553,740

[45] Date of Patent: Nov. 19, 1985

[54] FENCING

[75] Inventor: Alan Bailey, Cape Town, South Africa

[73] Assignee: Cape Gate Fence & Wire Works (Proprietary) Limited, Cape Province, South Africa

[21] Appl. No.: 606,630

[22] Filed: May 3, 1984

[30] Foreign Application Priority Data

May 10, 1983 [ZA] South Africa ..... 83/3337

[51] Int. Cl.[4] ..... E04H 17/02; B21F 27/00

[52] U.S. Cl. ..... 256/33; 256/73; 47/44

[58] Field of Search ..... 256/33, 34, 45, 73

[56] References Cited

U.S. PATENT DOCUMENTS 611,913 10/1898 Kees ..... 256/34 X
2,912,133 11/1959 Adrain ..... 256/45 X
3,651,851 3/1972 Curtis ..... 256/33 X
4,165,864 8/1979 Wright ..... 256/45 X

FOREIGN PATENT DOCUMENTS 1032475 6/1966 United Kingdom ..... 256/33

*Primary Examiner*—Andrew V. Kundrat
*Attorney, Agent, or Firm*—Bernard, Rothwell & Brown

[57] ABSTRACT

A fencing system including a series of mesh panels which can be connected to one another by means of fastening elements of inverted U-shaped form which are driven into the ground. Each panel includes a number of vertically spaced, horizontally extending wires which are offset laterally with respect to the vertical plane containing the bulk of the horizontal and vertical wires of the mesh. One limb of the U-shaped element passes between said vertical plane and said offset wires, the other limb being on the opposite side of said plane. A gate constituted by a fence panel turned through ninety degrees is also disclosed.

8 Claims, 10 Drawing Figures

FENCING

BACKGROUND TO THE INVENTION

A common kind of fencing consists of a series of fence posts between which wires are run and pulled taut. A diamond mesh is carried by the wires. Generally speaking, such fencing is only erected by commercial fencing companies as skill and special tools are needed to obtain a fence which is taut and visually acceptable.

Thus the homeowner cannot usually erect his own fencing successfully and it is often difficult for him to obtain his fencing from commercial fencing companies. Normally, a commercial fencing company does not find a contract for the relatively small length of fencing required for domestic purposes an attractive proposition. If the homeowner purchases the mesh, posts etc and undertakes the work himself, there is the prospect that the end result will be unsatisfactory both as regards appearance and also as regards durability. Consequently, the home owner is often forced to use wooden fencing or concrete walling instead of diamond mesh.

OBJECTS OF THE PRESENT INVENTION

The main object of the present invention is to provide a fencing system utilizing a wire mesh and which can be erected without the need for specialized tools.

Another object of the present invention is to provide a fencing system utilizing a wire mesh and which can readily be erected, taken-down and re-erected by the owner without calling in assistance from a commercial firm.

BRIEF DESCRIPTION OF THE INVENTION

According to one aspect of the present invention there is provided a fence structure including a mesh fence panel and a fence panel securing element of inverted U-shape, said panel comprising at least one horizontally extending zone at which at least one horizontally extending wire is offset horizontally with respect to the horizontally extending wires above and below it whereby these three wires bound a space which is open both upwardly and downwardly, said U-shape fastener comprising two spaced limbs, one of said limbs passing downwardly through said space behind said one wire and the other of said limbs passing downwardly externally of said space and behind the other two wires, the limbs of said fastener entering the ground to secure said panel to the ground.

According to another aspect of the present invention there is provided a fence panel which includes a series of horizontal wires and a series of vertical wires which together form a mesh, there being two vertically spaced, horizontally extending zones at each of which zones one horizontally extending wire is offset horizontally with respect to the horizontally extending wires above and below it whereby each group of three wires bounds a space which is both upwardly and downwardly open, said spaces, when the panel is vertical, being one above the other whereby a vertically located fastening element can be passed through said spaces.

The panel preferably has three of said zones which are vertically spaced with one zone near the upper edge of the panel, another near the lower edge of the panel and the third at mid-height of the panel.

According to a further aspect of the present invention there is provided a fence comprising a series of panels as defined above, and a series of fastening elements of inverted U-shape, each element having one limb which extends vertically through said spaces, and a second limb which extends vertically externally of said spaces.

According to a still further aspect of the present invention there is provided a gate comprising a panel which includes a series of horizontal wires and a series of vertical wires which together form a mesh, there being two horizontally spaced, vertically extending zones at each of which one vertically extending wire is offset horizontally with respect to the vertically extending wires on each side of it whereby each group of three wires bounds a space which is open on each side, there being rods passed horizontally through said spaces and protruding in opposite directions from the panel.

In one form of the gate, one of the end portions of each rod extends downwardly at right angles to the remainder of the rod to form a hinge element.

The present invention also provides a gate structure including a gate post including a pair of vertically spaced upwardly open sockets for receiving said one end portions.

BRIEF DESCRIPTION OF THE DRAWINGS

For a better understanding of the present invention, and to show how the same may be carried into effect, reference will now be made, by way of example, to the accompanying drawings in which.

DETAILED DESCRIPTION OF THE DRAWINGS

Figure 1:
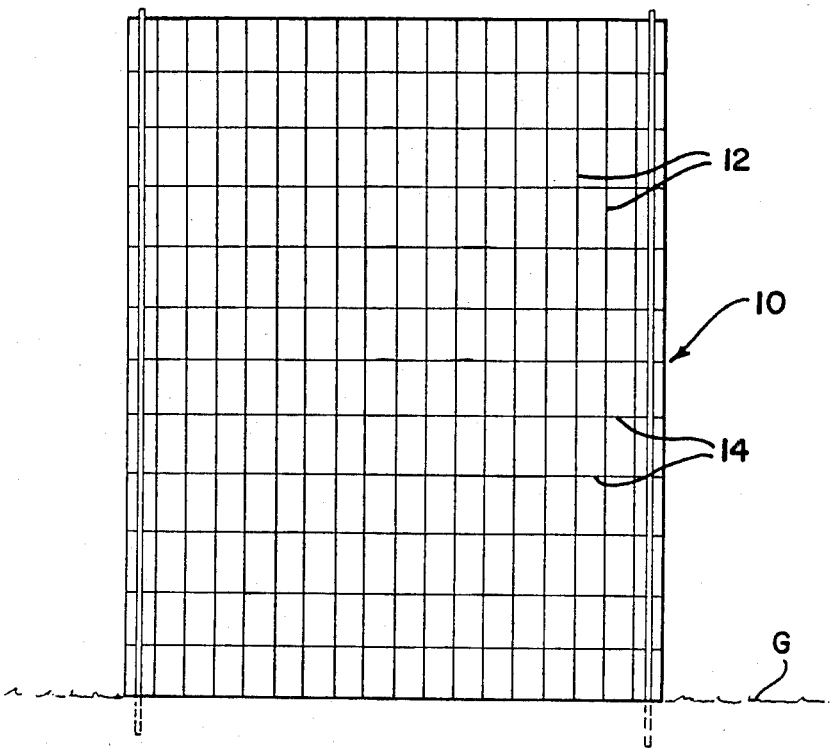
FIG. 1 is an elevation of a fence panel.
Figure 2:
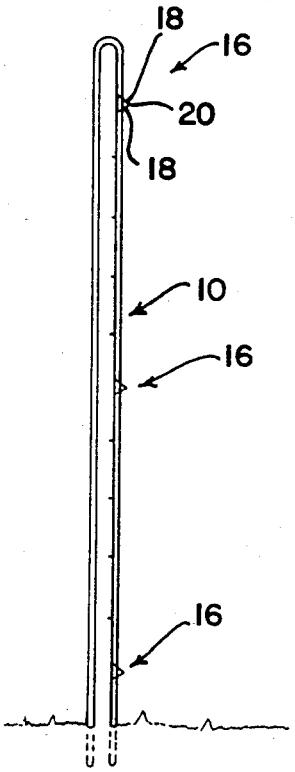
FIG. 2 is a side elevation of the fence panel of FIG. 1.

Referring firstly to FIG. 1, the fence panel 10 illustrated comprises a plurality of parallel, vertical wires 12 and a plurality of parallel horizontal wires 14 which are welded at their intersections to form a mesh. Each vertical wire 12 is kinked at three vertically spaced zones 16 (see FIGS. 2 and 4). Thus, at each zone 16, each vertical wire 12 has two sloping portions 18 which meet at an apex 20 which is offset laterally from the general plane in which all but three of the horizontal wires 14 lie. These three offset wires touch, and are welded to, the vertical wires 12 at the apices 20. As will be seen from FIG. 2, one zone 16 is near the upper edge of the panel 10, another zone 16 is near the lower edge of the panel 10, and the third zone 16 is at approximately mid-height.

Figure 4:
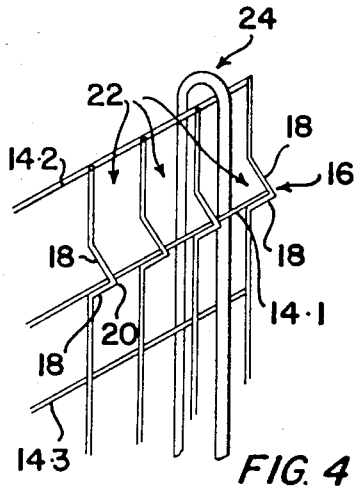
FIG. 4 is a pictorial view showing the way in which the fastening element of FIG. 3 co-operates with the fence panel of FIG. 1.

The upper horizontal wire which touches, and is welded to, the vertical wires 12 at the upper apex 20 has been designated 14.1 in FIG. 4 and two further horizontal wires have been designated 14.2 and 14.3. It will be noted that the wires 14.2 and 14.3 are one above the other and that the wire 14.1 is offset horizontally with respect thereto. This has the effect of providing a plurality of side-by-side spaces designated 22 in FIG. 4. These spaces lie to one side of the general plane containing all the wires 14 except the three offset wires 14.1. It will be understood that three sets of spaces 22 are created, each set extending horizontally and the sets being vertically spaced from one another.

Figure 3:
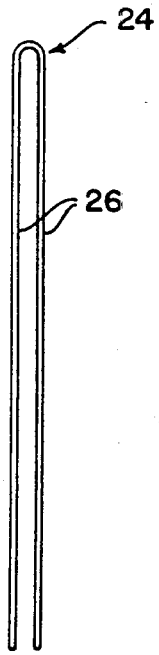
FIG. 3 is a view of a fastening element.

A fastening element 24 (FIG. 3) comprises two elongate, parallel limbs 26 which are joined by a U-bend.

The fence panel 10 is secured to the ground G by means of two elements 24. As will be seen from FIG. 4, one limb 26 is pushed down through the end space 22 of the upper set. Because the sets of spaces are vertically aligned, the limb also passes downwardly through the other two end spaces 22. The other limb 26 lies on the opposite side of the plane containing all the horizontal wires 14 except the wires 14.1. The element 24 is driven downwardly until the U-bend thereof engages, and presses on, the uppermost horizontal wire 14.2.

Figure 5:
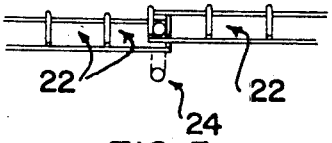
FIG. 5 is a detail showing the manner in which two fence panels overlap and are secured to one another by the fastening element of FIG. 3.

To secure two fence panels 10 together, vertical edge zones thereof are overlapped as shown in FIG. 5. This means that the vertically extending series of three spaces 22 at one edge of one panel comes into register with the vertically extending series of spaces at the edge of the other panel. One limb 26 of a fastening element 24 is then passed downwardly through the registering sets of spaces 22 until the lower ends of its limbs just penetrate the ground. The two fence panels are then pulled apart to the maximum extent possible and the element 24 driven the rest of the way in.

It will be understood that the panels do not need to be in the same vertical plane as one another. The plane in which all the horizontal wires (except the wires 14.1) of one panel lie can meet the corresponding plane of the other panel at an angle and thus a series of panels can together follow a curve.

Figure 6:
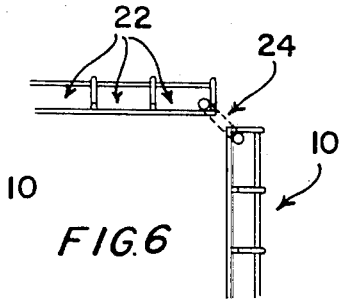
FIG. 6 illustrates two fence panels meeting at a right angle.

Referring now to FIG. 6, it will be seen that two panels 10 can be associated with one another at right angles and secured together by the fastening element 24.

Figure 9:
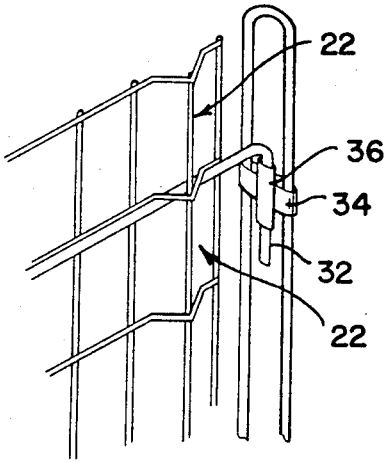
FIG. 9 illustrates a gate hinge.
Figure 7:
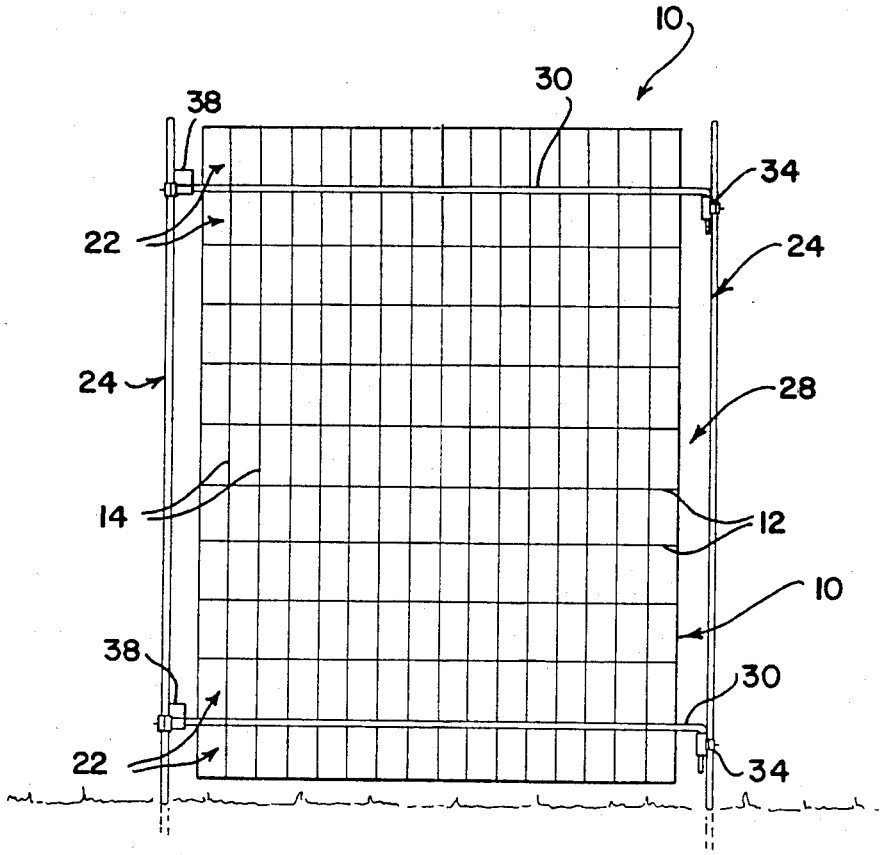
FIG. 7 is an elevation of a gate structure.
Figure 8:
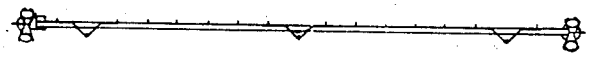
FIG. 8 is a top plan view of the gate structure.

In FIG. 7 there is illustrated a gate structure comprising two elements 24 which secure two fence panels 10 (not shown) in position. The illustrated elements 24 form gate posts and the gap between said two fence panels is closed by a gate 28. The gate 28 consists of a fence panel 10 turned through 90°. Thus the wires 12 now run horizontally and wires 14 now run vertically so that the zones 16 extend vertically instead of horizontally. Two rods 30 are pushed through hori-zontally aligned spaces 22 as shown in FIG. 8. It will be seen, particularly from FIG. 10, that the upper rod 30 passes through the second space 22 from the top of each set. The lower rod 30 passes through the lower space 22 of each set. The rods 30 protrude beyond the vertical end wires 14. One protruding end portion is bent at 90° to form a hinge element 32 (FIG. 9) and the other is straight (FIG. 10).

Two pairs of clamps 34 are secured, at vertically spaced positions, to the right hand element 24 in FIG. 7. Each of these clamps is formed with two part-circular grooves, the grooves, when in co-operating relationship, forming two vertically extending passages through which the limbs 26 of the element 24 pass. Welded or otherwise secured to the bolts which draw the clamps 34 towards one another are upwardly open sockets 36 (FIG. 9) which receive the hinge elements 32.

Figure 10:
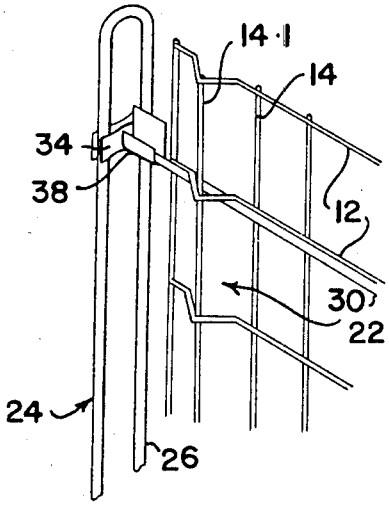
FIG. 10 illustrates a gate catch.

Similar clamps 34 are secured to the other element 24 (see FIG. 10). On this side of the gate structure there are U-shaped, upwardly open latches 38 which serve to receive the straight, protruding portions of the rods 30.

While the hinge elements 32 are fully entered in the sockets 36, the straight, protruding rod portions are within the latches 38 and are prevented from moving laterally by the vertical side walls of the latches 38. To open the gate, the panel 10 is lifted until the straight rod portions leave the latches 38. The length of each hinge element 32 is such that, when the straight rod portions leave the latches 38, the elements 32 are still within the sockets 36. Thus the gate does not come off its hinges but it can now be swung to an open position.

It will be noted that a gate which only opens one way is produced by making one side wall of the latch 38 taller than the other in the manner illustrated.

What is claimed is:

1. A fence structure including a mesh fence panel and a fence panel securing element of inverted U-shape, said panel comprising at least one horizontally extending zone at which at least one horizontally extending wire is offset horizontally with respect to the horizontally extending wires above and below it whereby these three wires bound a space which is open both upwardly and downwardly, said U-shaped fastener comprising two spaced limbs, one of said limbs passing downwardly through said space behind said one wire and the other of said limbs passing downwardly externally of said space and behind the other two wires, the limbs of said fastener entering the ground to secure said panel to the ground.

2. A fence panel which includes a series of horizontal wires and series of vertical wires which together form a mesh, there being two vertically spaced, horizontally extending zones at each of which zones each vertical wire has upper, lower and intermediate beds therein, the bends being such that each vertical wire has two sloping portions which meet at an apex constituted by the intermediate bend, said zones being spaced from the upper and lower horizontal edges of said panel so that the vertical wires extend both vertically upwardly and vertically downwardly from said upper and lower bends, there being one of the horizontally extending wires at each apex whereby said one horizontally extending wires are offset horizontally with respect to the horizontally extending wires above and below them, each group of three horizontal wires bounding a space which is both upwardly and downwardly open, said spaces, when the panel is vertical, being one above the other such that a vertically located fastening element can be passed through said spaces.

3. A fence panel as claimed in claim 2, and which has three of said zones which are vertically spaced with one zone near the upper edge of the panel, another near the lower edge of the panel and the third at mid-height of the panel.

4. A fence comprising a series of fence panels, including a series of horizontal wires and a series of vertical wires which together form a mesh, there being two vertically spaced, horizontally extending zones at each of which zones one horizontally extending wire is offset horizontally with respect to the horizontally extending wires above and below it whereby each group of three wires bounds a space which is both upwardly and downwardly open, said spaces, when the panel is vertical, being one above the other whereby a vertically located fastening element can be passed through said spaces; and a series of fastening elements of inverted U-shaped, each element having one limb which extends vertically through said spaces, and a second limb which extends vertically externally of said spaces.

5. A gate comprising a panel which includes a series of horizontal wires and a series of vertical wires which together form a mesh, there being two horizontally spaced, vertically extending zones at each of which one vertically extending wire is offset horizontally with respect to the vertically extending wires on each side of it whereby each group of three wires bounds a space which is open on each side, there being rods passed horizontally through said spaces and protruding in opposite directions from the panel.

6. A gate comprising a panel which includes a series of horizontal wires and a series of vertical wires which together form a mesh, there being two horizontally spaced, vertically extending zones at each of which one vertically extending wire is offset horizontally with respect to the vertically extending wires on each side of it whereby each group of three wires bounds a space which is open on each side, there being rods passed horizontally through said spaces and protruding in opposite directions from the panel, and one of the end portions of each rod extending downwardly at right angles to the remainder of the rod to form a hinge element.

7. A gate structure including a gate according to claim 6, and a gate post including a pair of vertically spaced, upwardly open sockets for receiving said one end portions.

8. A fence as claimed in claim 4, and which has three of said zones which are vertically spaced with one zone near the upper edge of the panel, another near the lower edge of the panel and the third at mid-height of the panel.

* * * * *